US005397202A

United States Patent [19]

Shrader et al.

[11] Patent Number: 5,397,202

[45] Date of Patent: Mar. 14, 1995

[54] ANCHOR BOLT INSTALLATION METHOD

[75] Inventors: Samuel E. Shrader, McMurray; Harry C. Tritapoe, Martinsburg, both of Pa.

[73] Assignee: E. I. Du Pont de Nemours and Company, Wilmington, Del.

[21] Appl. No.: 299,122

[22] Filed: Sep. 2, 1994

Related U.S. Application Data

[63] Continuation-in-part of Ser. No. 146,813, Nov. 3, 1993.

[51] Int. Cl.[6] ..... E21D 20/02

[52] U.S. Cl. ..... 405/259.6; 52/704; 405/259.1; 405/259.5

[58] Field of Search ..... 405/259.6, 259.5, 259.1, 405/244, 239; 52/698, 704

[56] References Cited

U.S. PATENT DOCUMENTS

| | | | |
|---|---|---|---|
| 0,353,463 | 10/1982 | Seemann | 405/254.6 |
| 3,860,475 | 1/1975 | Simmons | 156/285 |
| 3,861,522 | 1/1975 | Llewellyn et al. | 206/219 |
| 3,889,446 | 6/1975 | Simmons et al. | 53/28 |
| 3,918,235 | 11/1975 | Brown et al. | 53/28 |
| 4,126,005 | 11/1978 | Coursen | 405/261 |
| 4,126,009 | 11/1978 | Tomic | 405/260 |
| 4,127,001 | 11/1978 | Tomic | 405/261 |
| 4,280,943 | 7/1981 | Bivens et al. | 260/29.2 |
| 4,556,344 | 12/1985 | White | 405/261 |
| 4,616,050 | 10/1986 | Simmons et al. | 523/220 |
| 4,750,887 | 6/1988 | Simmons | 405/260 |
| 4,991,563 | 2/1991 | Ashley | 126/401 |
| 5,127,769 | 7/1992 | Tadolini et al. | 405/259.5 |

FOREIGN PATENT DOCUMENTS 91-2001 10/1987 Rep. of Korea .

*Primary Examiner*—Dennis L. Taylor
*Attorney, Agent, or Firm*—George A. Frank

[57] ABSTRACT

An improved method of installing tensional anchor bolts or cable bolts into a geological or man made formation by preheating anchor bolts or cables prior to inserting them into a borehole, mixing the bonding material within the borehole by rotating the bolt and allowing curing of the bonding material prior to the cooling of the bolt, thereby placing the bolt under tension and the formation into compression, is provided.

3 Claims, 2 Drawing Sheets

ANCHOR BOLT INSTALLATION METHOD

REFERENCE TO RELATED U.S. APPLICATIONS

This application is a continuation-in-part of application Ser. No. 08/146,813, filed Nov. 3, 1993.

BACKGROUND OF THE INVENTION

The present invention relates to an improved method for installing a resin-grouted anchor bolt in a borehole, and, more particularly, to an improved method of quickly securing an anchor bolt or cable in a borehole using a settable bonding material. The improvement comprises heating the bolt to a temperature at least approximately 40° above ambient temperature prior to contacting the bolt and bonding material during the installation procedure whereby curing is accelerated, and the bolt is placed under tension without mechanical torquing.

In the art of bolt anchoring systems, and especially in mine roof support, it is well known how to tension bolts by the use of a shell-type, plastic or metallic-sleeve mechanical expansion system with and without resin. Non-mechanical anchor bolts of the type which are installed with a settable bonding material are normally placed under tension after the bonding material has reached a predetermined initial cure strength by torquing a nut or a bolt on the exposed bolt end. Popular bonding materials; e.g., polyesters, epoxies, and other known commercially available synthetic resins, are typically provided in packages in which the resin and a catalyst for the resin are separated by a package film or reacted zone of the resin. During normal installation when the anchor bolt, or anchor bolt assembly, is forced into a drilled borehole which already contains the resin/catalyst package, the bolt breaks the package and then mixes the resin and catalyst as it is rotated from 30 to about 100 revolutions at a rate of 150 rpm to 1200 rpm. At ambient mine temperatures, which can range from 3° to 35° C., the elapsed time from insertion of the bolt until the resin reaches a satisfactory cure strength and can be torqued into tension can range from 14 seconds up to about 60 seconds.

Another method of securing a bolt or cable utilizes cementitious materials. Cementitious materials, packaged for water soaking or pumpable, are used in securing bolts and cables in various geological strata.

Packaged cementitious materials are soaked in water prior to inserting into the borehole. The bolt or cable is then installed through the cementitious material. Alternatively, the bolt or cable is installed first followed by pumping the cementitious material into the hole to grout the system.

U.S. Pat. No. 4,353,463, issued Oct. 12, 1982 to R. W. Seemann, discloses a cartridge assembly of a multicomponent curable system for use in anchoring bolts into solid structures wherein preheating the cartridge and/or the bolt can reduce reaction time. In such a system, the resin curing time is less than the bolt warming time and, therefore, the bolt goes into compression and the solid structure goes into tension. There is a need to achieve the opposite effect, that is, for the bolt to go into tension and the solid structure to go into compression. To achieve that, there is a need for a system where resin curing time is less than bolt cooling time.

SUMMARY OF THE INVENTION

The present invention provides an improved method for anchoring a bolt under tension in a borehole comprising the steps of:

(a) introducing a curable bonding material into a borehole wherein said material is compartmentalized prior to introduction to prevent curing;

(b) heating a bolt to a temperature at least 40° C. above ambient temperature prior to insertion into said borehole;

(c) inserting and rotating the heated bolt into the borehole thereby mixing the components of said bonding material; and (d) keeping the bolt stationary for a time sufficient to allow the bonding material to reach minimum cure strength.

The improvement according to the present invention comprises heating a bolt either partially or its entire length to a temperature in the range of at least 40° C. above ambient mine temperature prior to insertion into the borehole whereby curing of a resin or cementitious material present in the borehole to a satisfactory initial cure strength is accelerated. Slow cooling of the bolt thereafter places it under tension without the need for a separate torquing step. The elapsed time from bolt insertion until the bonding material reaches its minimum satisfactory initial cure strength is reduced to about 3 to 7 seconds in torque tension and combination bolt applications. The process of this invention substantially reduces overall installation time per bolt and helps to achieve the stress distribution characteristics of a tensioned grouted bolt support system without the need for a separate bolt torquing step.

DETAILED DESCRIPTION OF THE INVENTION

Figure 1:
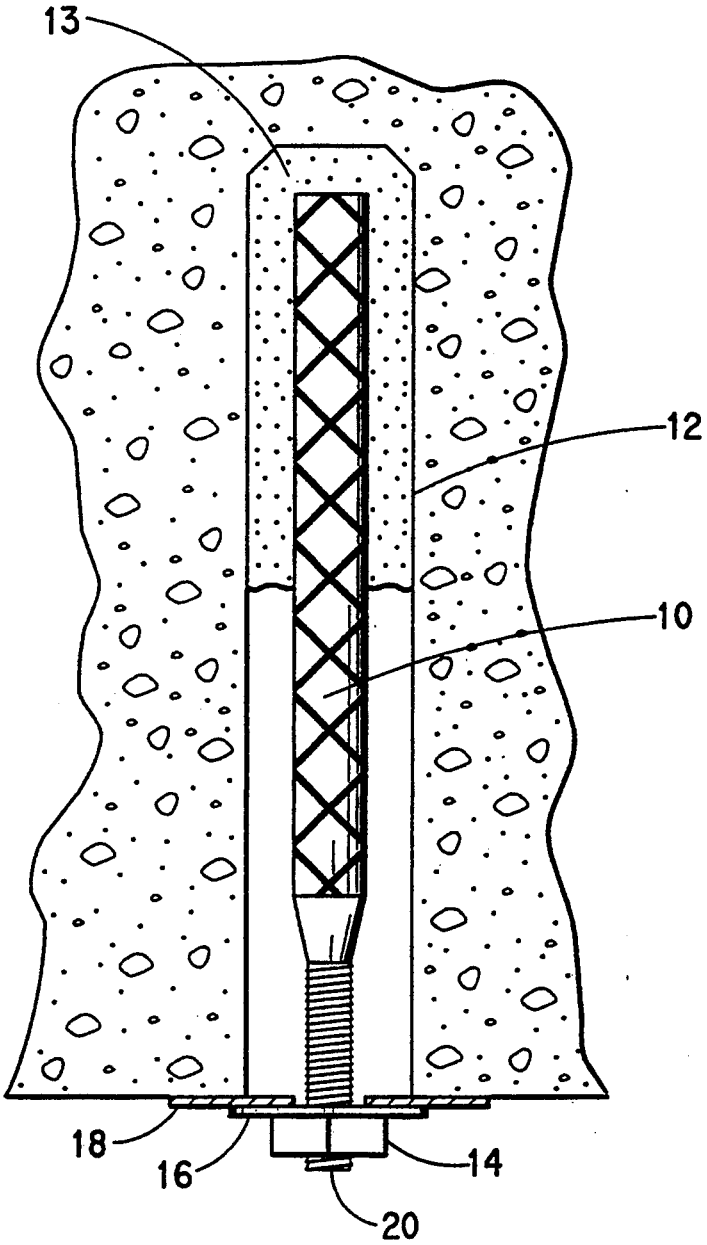
FIG. 1 is a sectional view of a typical partially grouted torque tension roof bolt after bolt torquing.

The present invention is an improvement in the method for installing grouted cable or anchor bolts using a bonding material such as a compartmented resin-catalyst package which comprises heating the anchor or bolt to a temperature at least 40° C. above ambient mine temperature. The upper temperature is limited by the deterioration temperature of bonding material prior to inserting it into a borehole. A typical installation procedure of the prior art for installing (roof) anchor bolts or cable bolts in an underground mine comprises the steps of:

(a) drilling a borehole of suitable diameter in the range of from $\frac{5}{8}$ inch to $1\frac{3}{8}$ inch (1.6 cm to 5.7 cm) and depth of from about 1 foot up to 20 feet (30.5 cm to 610 cm);

(b) introducing a bonding material into the borehole, usually contained in a two-compartment package in which one compartment contains a curable material and the other compartment contains a catalyst;

(c) inserting an anchor bolt into the borehole thereby rupturing the divider between the compartments of the package and breaking open the package;

(d) spinning the bolt to mix the curable material and catalyst into a substantially homogeneous mass;

(e) holding the bolt stationary, e.g., for about 14 to 22 seconds, to achieve partial setting of the grout, thereby reaching an initial minimum cure strength; and (f) torquing the bolt to place it under tension.

By heating the bolt according to the present invention prior to insertion into the borehole, the grouting material reaches its satisfactory initial cure strength and places the bolt under tension as it contracts during cooling without the need for a separate bolt torquing step. "Heating the bolt" means that all or a portion of the elongated shank of the bolt is heated to a preselected temperature. This way at least a portion of the heated bolt will come in contact with the bonding material in the borehole. The bonding material must cure sufficiently fast so as to achieve sufficient strength to bond the bolt to the borehole wall prior to substantial cooling of the bolt. It is only this way that the bolt can go into tension and the roof into compression. For example, if the bolt is heated approximately 100° C. above the roof (rock) temperature and it then cools to approximately 50° C. above ambient temperature prior to the curing of the grouting material, approximately one-half of the possible tension would be lost. On the other hand, if the bolt only cools to approximately 98° C. above ambient temperature, then approximately 98% of the tension would be retained. As a general proposition, it is preferable that the bolt cools less than 15% of its temperature above ambient temperature prior to the curing of the grouting material.

Anchor bolts of the type contemplated for use according to the invention are typically deformed carbon steel bars (rebars) configured, e.g., threaded, at one end with a detachable nut or other convenient means, for rotation using a machine-driven socket. The configured end of the anchor bolt can also include an enlarged washer or roof plate which can improve distribution of stresses along the mine roof surface. The exact configuration of the bolt or bolt assembly can vary widely depending on the manufacturer and the preference of the mine operator. However, since roof support in an underground mine can account for up to 30% of the total cost of mine operation, the cost of materials and installation time; i.e., bolt "cycle time", are two critical factors which influence which bolt configuration is used and whether installation includes a settable bonding material. Typically, installation time for a resin-grouted bolt tends to exceed installation time for a non-grouted mechanical shell, plastic or metallic-sleeve expansion bolt while a resin-grouted bolt is known for more effective distribution of stress in a given rock formation and for durability.

Referring now to the figures, FIG. 1 is a sectional view of a typical partially grouted "torque-tension" roof bolt of the prior art after bolt torquing. Bolt 10 as shown is a deformed carbon steel bar which can vary in diameter from $\frac{5}{8}$ inch to $1\frac{3}{8}$ inch (1.6 cm to 3.5 cm) and from about 1 foot up to 20 feet in length (30.5 cm to 610 cm). A curable bonding material 13 fills the inward portion of the annular space between the bolt and borehole 12. The exposed end of the anchor bolt includes a nut 14, a washer 16, and a roof plate 18. Nut 14 will not spin independently of the nut/bolt assembly until after a shear device is broken by rotating at the nut after the bolt spin time and the hold time. After the hold time, the nut is rotated to break the shear device and tighten it to place the nut/bolt assembly under tension. Typical shear devices can break at 75, 100 or 120 ft-lbs. as desired. The shear device can be a shear pin or a dome on the end of the nut. A fully grouted roof anchor bolt, or the partially grouted bolt as shown, can provide excellent roof support. The tensioned bolt shown in FIG. 1 also includes an exposed thread portion 20. The exposed end of bolt 10 is threaded so that turning nut 14 after grout 13 has reached an initial cure strength will place the bolt under tension. If, however, nut 14 is torqued prematurely; i.e., before grout 13 can reach a satisfactory minimum cure strength, bolt 10 can be pulled out of borehole 12 as nut 14 is turned and advances along threads 20. The exposed threads can become a safety hazard especially in low roof coal mines.

Figure 2:
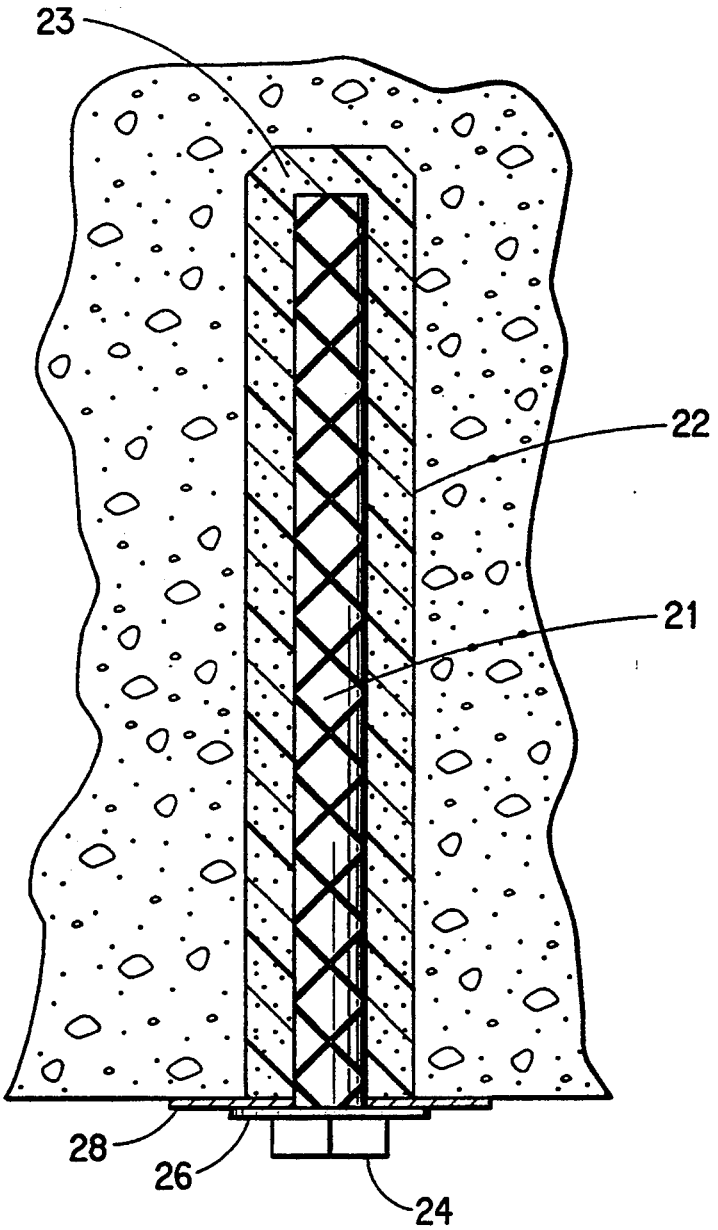
FIG. 2 is a sectional view of a resin grouted bolt installed according to the invention.

FIG. 2 is a sectional view of a fully grouted tensioned anchor bolt which has been installed according to the present invention. The bolt comprises a deformed carbon steel bar 21 with the exposed end configured with a bolt head 24 for rotating the bolt to mix the resin components to a substantially homogeneous bonding material 23. As with the partially grouted bolt shown in FIG. 1, the fully grouted anchor bolt 21 includes a washer or bolt head shoulder 26 and a roof plate 28. The anchor bolt installed and placed under tension according to the invention has no exposed threads and can be partially or fully grouted as shown.

Bonding materials useful in practicing the invention can be any of a variety of inorganic or organic curable compositions depending on a number of factors, such as the nature of the rock formation, cost, availability and preference of the mine operator. Such bonding materials include cementitious grout and multicomponent organic systems capable of hardening upon mixing the components or upon exposure to moisture or air. Organic systems generally can include an unsaturated polyester resin, monomers, promoters, inhibitors, thickeners, and catalysts. The resins can be based on anhydrides such as maleic anhydride and phthalic anhydride and glycols such as propylene glycol and ethylene glycol. Promoters include N,N-dimethylaniline and N,N-dimethyltoluidine; inhibitors include hydroquinone, naphthaquinone, t-butylcathecol and t-butylhydroquinone. Catalysts are generally peroxides such as benzoyl peroxide. Often, both the resin and catalyst compartments contain limestone particles as a filler to transmit load. Bonding materials both prior to and subsequent to curing are often referred to as grout. Best results are usually achieved using organic grouting compositions of the type described in U.S. Pat. No. 4,280,943, incorporated herein by reference. In a preferred embodiment the grout is a catalyzed polyester resin available commercially under the name Fasloc ® (a registered trademark of E. I. du Pont de Nemours and Company). The resin component occupies one compartment and the catalyst component occupies an adjoining compartment of a two-compartment frangible "chub" cartridge, such as that described in U.S. Pat. Nos. 3,795,081 and 3,861,522. The ratio of resin to catalyst and the presence of additives and other fillers are not critical to the method of this invention and can vary widely over a broad range. The cartridge can be made from various materials such as polyethylene terephthalate film which can break as the anchor bolt is inserted into the borehole, allowing the two components to mix together. Rotation of the bolt immediately upon insertion of the bolt for about 30 to 50 revolutions at a rate of from 300 rpm to 500 rpm insures thorough mixing of the components into a substantially homogeneous quick-curing grout.

Once a borehole has been drilled, one or more resin cartridges can be inserted followed immediately by the anchor bolt. Insertion of the bolt can be conveniently accomplished using a bolting machine specially designed with a machine-driven socket for engaging the configured end of the bolt and upwardly thrusting the bolt into the borehole. These machines are widely available in the mining industry. Typically, the time needed for commercially available catalyzed grouting systems to reach a minimum cure strength sufficient for bolt torquing and thereafter to support the bolt when the upward force of the bolting machine is released, measured from the instant the bolt is thrust into the borehole, can range from a low of 12–14 seconds up to 22 seconds. This is referred to as "bolt cycle time". According to the present invention, bolt cycle time can be substantially reduced by heating the bolt along the shank portion to a temperature in the range of from approximately 66° C. to 155° C. prior to inserting it into the borehole. The elevated temperature of the bolt accelerates the curing rate of the catalyzed grouting system so that the grout will reach a satisfactory minimum cure strength in the range of approximately from 4.5 to 9 metric tons substantially sooner than it would utilizing customary installation procedures. Because of this, the bolting machine can be released sooner to install the next bolt. Depending on the type of anchor bolt utilized and the length of the portion of the bolt heated, the bolt can be torqued to develop tension in addition to the tension imparted to the bolt as it cools. Alternatively, as the anchor bolt contracts as it cools, it is thereby placed under tension without the need for a separate bolt torquing step.

Although several means are available for heating anchor or cable bolts and/or bonding materials, preferred for use in underground mines is an electric induction heating device. Friction, convective and direct heating systems can also be used.

In the Examples which follow, "gel time" of a given resin formulation is the time that elapses between the mixing of the reactive components and the reaching of minimum cure strength. Gel times can be influenced by several factors such as by the use of promoters, inhibitors and by varying the initiator concentration. Cartridges containing different formulations having different gel times in the same cartridge have been developed for long bolt applications. Alternatively, two separate cartridges, one having a fast set gel time and one cartridge having a slower gel time, can be utilized with long bolts. In such cases, the faster fast gel time cartridge is inserted first, followed by the slower one prior to the insertion of the bolt improved bolt cycle time.

In the process of this invention, utilizing a heated bolt system, one can achieve the desired results with one standard gel time system by heating the bolt in specific designated areas.

The following are commonly accepted definitions and are referred to in the Examples which follow.

"Gel time" is a rating test and is correlated to "in-hole" performance. It is a laboratory measurement by physically mixing a ratioed weight of catalyst to resin until the material begins to gel. The material is considered gelled when it becomes hard. The test is conducted at ambient temperatures and extrapolated to 55° F. which is the normal mine temperature. The time from beginning the mixing until the resin reaches a hard state is the gel time.

"Borehole gel time" is measured as follows: A resin cartridge is placed in a steel borehole. A rebar bolt is installed into the steel borehole through the resin. The bolt is rotated while the steel borehole is stationary. The rotation is continued until the resin reaches adequate strength to stall out the bolt installation machine which is supplying 400 ft-lbs. of torque. The time from beginning the bolt rotation until stalling the machine (lock-up) is the borehole gel time (BGT).

"Bolt-Spin Time" is the time of bolt rotation after it is inserted through the resin to mix the resin and catalyst components. Bolts are rotated at 500 rpm.

EXAMPLE 1

In this example, bolt cycle times were compared with and without heating the anchor bolt, for the selected resin of fully grouted bolts to reach a minimum satisfactory cure strength using one-minute and 30-second gel time resins.

One inch ID pipe (2.5 cm), four feet long (122 cm) was used as simulated boreholes. The bolts were ¾"rebar (1.9 cm) four feet long (122 cm) with a fixed nut on the exposed end. Each bolt had a 2" square (5.1 cm) washer above the nut. One-half of the bolts were heated in an electric furnace to an average temperature of 175° F. (79° C.). In each case, a 1½ feet (46 cm)-portion of the bolt, the portion coming in contact with the grout, was heated.

In each run, first a resin cartridge and then the anchor bolt were inserted upwardly into the simulated borehole. The top of the borehole was fixed against a steel plate, and the head of the bolt was engaged by the socket of a bolt driving machine. The upward force of the machine drove the bolt through the resin cartridge, and rotated the bolt rapidly for about 30 to 50 revolutions (at a rate of about 500 rpm) to mix the resin. Rotation was continued until the resin hardened (cured) sufficiently to stop the machine at a pre-set torque of 400 foot pounds. This time period is referred to as borehole gel time (BGT).

Table I gives the results of these tests, each test representing an average of 3 bolt installations; utilizing the process of this insertion reduced total installation time (bolt anchoring) by over 40% (and insertion time by over 20%). This is necessary to insure that the resin cured sufficiently prior to substantial cooling of the bolt.

TABLE I

| | Bolt Temperature | |
|---|---|---|
| | 72° F. (22° C.) | 175° F. (79° C.) |
| | 30 Second Resin | |
| Insertion Time (sec) | 7.7 | 6 |
| Borehole Gel Time (sec) | 10.7 | 5 |
| Totals (sec) | 18.4 | 11 |
| | 1 Minute Resin | |
| Insertion Time (sec) | 7.7 | 6 |
| Borehole Gel Time (sec) | 19.7 | 8.3 |
| Total (sec) | 27.4 | 14.3 |

The data in Table I indicate that the resin reached adequate cure strength prior to the bolt cooling by more than 15% of its elevated temperature thereby providing for the bolt to go into tension.

EXAMPLE 2

This example covers tension development upon bolt cooling. Bolts are shown in FIG. 2 were used as follows. The bolts were 4 feet long (122 cm) and ¾ inch (1.9 cm) in diameter and for each test were inserted into a simulated borehole which was 4 feet long (122 cm) and 1 inch (2.5 cm) in diameter.

Each bolt had a forged head on the exposed end for engagement by the socket of a bolt driving machine. The bolts were heated to 200° F. (93° C.) over their entire length. Different bonding materials, 15-sec. and 30-sec. gel time resins, FASLOC B-Fast resins, available from E. I. du Pont de Nemours and Company were inserted into the borehole either into 2-foot or 4-foot portions, immediately followed by a bolt with a hydraulic load cell. After bolt insertion through the resin was completed, each bolt was spun to mix the bonding material. Full up-thrust was applied to the bolts and held to allow adequate resin strength development. "Hold Time" is the time period after mixing (bolt spin time) has stopped, when full upthrust is applied, at 5700 lb, to the bolt head and when full upthrust to the bolt head is stopped. While the initial upthrust is applied at 5700 lb, the initial tension value shown in Table II is the value measured upon release of the upthrust force. Theoretically the applied upthrust and measured upthrust upon release should be identical, in practical applications, however, there can be some diminishing of the force. As the bolts cooled, tension increased in the bolts as indicated by the hydraulic load cell. There was no torque applied to develop tension, tension actually developed by bolt contraction over the entire length of the bolts and was measured 30 min. after installation was complete ("final tension"). Results are tabulated in Table II:

TABLE II

| Bonding Material | | Bolt Spin | Hold Time | Tension (lb) | |
|---|---|---|---|---|---|
| Gel Time (sec.) | Length (ft.) | Time (sec.) | (sec.) | Initial | Final |
| 30 | 4 | 2 | 18 | 5700 | 8000 |
| 15 | 2 | 2 | 10 | 3400 | 7400 |
| 30 | 4 | 3 | 15 | 5700 | 9150 |
| 15 | 2 | 3 | 10 | 4300 | 8600 |
| 15 | 4 | 4 | 10 | 4600 | 8300 |
| 15 | 4 | 4 | 10 | 4600 | 8200 |

As can be seen from the above, tension increased in the bolt system gradually over a 30-min. period utilizing the anchoring method of this invention. The increase was at least approximately 40% under this particular set of conditions and, in general, amounted to approximately 1–2 ton over the initial (base) load. Prior systems do not provide tension increase over time in bolting systems unless the bolt is torqued after curing the bonding material. Such torquing would also require additional threaded parts on the bolt.

In contrast, when the resin cartridge was heated to 157° F. (69.4° C.) and the bolt and steel borehole were at ambient temperatures, the data shown in Table III were obtained. Installation procedure was identical to that used above in obtaining data for Table II.

TABLE III

| Bonding Material | | Bolt Spin | Hold Time | Tension (lb) | |
|---|---|---|---|---|---|
| Gel Time (sec.) | Length (ft.) | Time (sec.) | (sec.) | Initial | Final |
| 30 | 4 | 5 | 20 | 5700 | 3920 |
| 30 | 4 | 5 | 20 | 4630 | 2280 |

As can be seen from the above, heating the resin instead of the bolt, tension does not increase, but actually decreases. This can be explained by the fact that since the resin is warmer than the bolt, the bolt begins to expand as it is heated by the resin and is pushed out of the curing resin, thereby losing its tension.

We claim:

1. A method for anchoring a bolt under tension in a borehole comprising the steps of:
   (a) introducing a curable bonding material into a borehole wherein said material is compartmentalized prior to introduction to prevent curing;
   (b) heating a bolt to a temperature at least 40° C. above ambient temperature prior to insertion into said borehole;
   (c) inserting and rotating the heated bolt into the borehole thereby mixing the components of said bonding material; and
   (d) keeping the bolt stationary for a time sufficient to allow the bonding material to reach minimum cure strength; said time sufficient for the curable bonding material to reach minimum cure strength being less than the time needed for the bolt to cool by 15% of the temperature above ambient temperature to which it had been heated prior to insertion into the borehole.

2. The method of claim 1 where the bolt is an anchor bolt or a cable bolt.

3. The method of claim 1 wherein the curable bonding material is selected from cementitious grout and crosslinkable multi-component organic systems.

* * * * *